United States Patent [19]

Novy

[11] Patent Number: 4,840,250

[45] Date of Patent: Jun. 20, 1989

[54] ACOUSTIC IMPEDANCE INDUCING DEVICE

[76] Inventor: Donald A. Novy, 1234 S. Quince Way, Denver, Colo. 80231

[21] Appl. No.: 236,669

[22] Filed: Aug. 25, 1988

[51] Int. Cl.[4] ..... G10D 9/00; G10K 11/00

[52] U.S. Cl. ..... 181/175; 181/185; 84/392; 84/453

[58] Field of Search ..... 181/175, 177, 178, 181, 181/185; 84/392, 394, 396, 453, 456

[56] References Cited

U.S. PATENT DOCUMENTS

| | | | |
|---|---|---|---|
| 842,707 | 1/1907 | Rose | 181/185 |
| 872,592 | 12/1907 | Wangemann | 181/185 |
| 1,770,234 | 7/1930 | Grost | 181/185 |
| 3,973,464 | 8/1976 | Novy | 84/392 |

OTHER PUBLICATIONS

F. C. Karal, "The Analogous Acoustical Impedance For Discontinuities and Constrictions of Circular Cross Section," The Journal of the Acoustical Society of America, Mar. 1953.

*Primary Examiner*—B. R. Fuller
*Attorney, Agent, or Firm*—Kyle W. Rost

[57] ABSTRACT

An acoustical impedance inducing device is created for axial insertion into the longitudinal air column of a wind musical instrument. The device includes a first annular band of first predetermined thickness and a second annular band of approximately twice the thickness of the first band. A first web interconnects the first and second bands and maintains the bands at a predetermined axial spacing. The web is formed of strips diagonally disposed between the first and second bands and defining a triangle shaped aperture between adjacent bands, with the base of the triangle being colinear with an edge of one of the first and second bands. A third annular band, twice the thickness of the second, may be separated from the second band by a second web; or the device may be placed in a tubular portion of the instrument at a location where an end of the tubular portion is spaced from the second band by the axial width of the web.

21 Claims, 1 Drawing Sheet

ACOUSTIC IMPEDANCE INDUCING DEVICE

BACKGROUND OF THE INVENTION

1. Field of the Invention

The invention relates to music and to musical instruments. More specifically, the invention relates to all types of wind instruments and especially to brasses and woodwinds having an air column contained therein that creates transverse sound waves when induced into longitudinal vibration.

2. Description of the Prior Art

In a music instrument having an air column, the shape of the air column determines the resonant frequencies that will be produced by the instrument. It is known that an abrupt change in the circular cross-section of a tube introduces increased impedance and that the effect of such a discontinuity is to introduce an inductance in series with the standing waves of the air column, thereby producing a reinforced response in the instrument.

U.S. Pat. No. 3,973,464 to Donald A. Novy discloses a piston valved brass-wind musical instrument having an exponentially offset series of reflective, eliptically constricted bore sections. The amounts of offset are based upon a percentage of the inside bore diameter taken at mid-bore length. This series of interferences, exponentially doubled at each piston's ports, creates an analogous impedance that significantly improves the response of the instrument, thereby making it easier to play and affording the player benefits of improved range, endurance, intonation and dynamic control.

While the noted patent imparts significant advantages to a piston valved instrument, it would be desirable to extend the benefits to other types of wind instruments, including non-valved instruments.

Further, an alternative technique of achieving these benefits would be desirable even in a piston valved instrument, in which it would be unnecessary to re-align the pistons.

To achieve the foregoing and other objects and in accordance with the purpose of the present invention, as embodied and broadly described herein, the acoustic coil and method of manufacture of this invention may comprise the following.

SUMMARY OF THE INVENTION

Against the described background, it is therefore a general object of the invention to provide an improved apparatus and technique for creating a series of discontinuities and constrictions in the cross-section of an acoustical transmission system, either with or without valves.

Another object is to provide a versatile device capable of structuring discontinuities and constrictions into exponentially sized amounts, such as the 4:2:1 ratio of U.S. Pat. No. 3,973,464, without realigning valves.

A further object is to apply constructive exponentially related interferences to the air column of wind musical instruments in order to reinforce the propagation of sound by means of a slightly greater than bore size compressible plastic coiled sleeve insert to the bore, the edges of which represent interferences in exponential and symmetrical relationships that are constructive to the standing waves contained therein.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, an acoustical impedance inducing device is created for axial insertion into the longitudinal air column of a wind musical instrument. The device includes a first annular band of first predetermined thickness and a second annular band of second predetermined thickness, wherein the second predetermined thickness is approximately twice the first predetermined thickness. A first web interconnects the first and second bands and maintains the bands at a predetermined axial spacing. The web is formed of strips diagonally disposed between the first and second bands and defining a triangle shaped aperture between adjacent bands, with the base of the triangle being colinear with an edge of one of the first and second bands.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENTS

Figure 1:
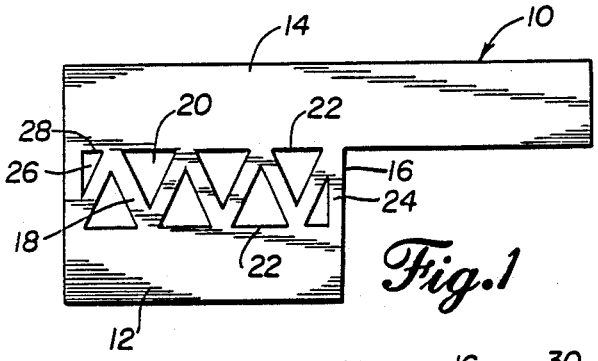
FIG. 1 is a plan view of a blank of a first embodiment for the impedance inducing device the present invention.

The invention constitutes a series of axially spaced apart rings that can be placed in the air column of a wind musical instrument in an ordered sequence in order to create discontinuities and constrictions in the air column. In particular, the rings have a relative thickness such that each one is half the thickness of its preceding neighbor. Thus, a sequence of two such rings has a thickness ratio of 2:1 and a sequence of three such rings has a ratio of 4:2:1. The rings are spaced apart axially within the air column by a regular, predetermined spacing. This spacing is achieved by a web that connects at least two of the rings, holding these rings at a predetermined relative distance. A sequence of three rings is desired, and the third ring, when present, also may be connected by a web to its neighbor.

The web is employed to assure that the rings maintain their spacing and position. When the rings are inserted into the air column of an instrument, the actual insertion process requires that the rings be placed within the tubing of the instrument. Some of the possible locations for insertion include a tuning slide, a tuning pipe, a lead-pipe, a tenor section, or a mouthpiece receiver. The exact preferred location depends upon the particular instrument. However, accurately placing rings in any of these locations and assuring that the rings remain in proper relative relationship would be difficult if the rings are independent of each other. Thus, the web enables the proper placement of all rings in a single insertion operation.

The design of the web is important to the proper operation of the impedance inducing device. The radial thickness of the ring is a direct factor in producing a constriction in the air column and in creating the desired impedance. However, the axial or longitudinally facing edges of the rings also function to propagate reinforcing sound waves. The web covers a portion of these edges and, thus, eliminates such a portion of the edges from active participation in the process of improving the response of the instrument. The preferred web design minimizes the covered portion of the ring edges.

Since instrument bores may differ in diameter both between manufacturers and models, an insertable and removeable ring requires some means of being adapted to small variations in bore size. Thus, the rings are formed in wound coils and are produced from a material having resilience in the coil structure. The preferred material is industrial polyester, which can be obtained in sheets of uniform, predetermined thickness. The impedance inducing device can be cut as blanks from such sheets and then wound into the desired coil shape. The coiled blanks can be placed in a cylindrical container, heat treated, and then cooled to cause the new shape to become permanent, although the sheet maintains resilience within the coil shape. Thus, the coil can be compressed for purposes of insertion into an instrument, and the natural resilience will cause the coil to spring outwardly for purposes of position retention within the instrument's tubing.

A first style of blank 10 is shown in FIG. 1 to include a first band 12 and a second band 14. The second band is twice the length of the first. When the bands are wound into cylindrical shape, the resulting second annular band will have twice the wall thickness as the first. In the embodiment of FIG. 1, the first band is the shortest band of the device. Thus, the first band is wound into a circle of one revolution, and the second band is wound into a circle of two revolutions. The lengths of the first and second bands are selected to be such that the bands form substantially complete circles when wound to the inside diameter of the instrument with which the device is adapted for use. Small variations in the completeness of the circles is acceptable.

The web 16 interconnects bands 12 and 14. The length of the web is sufficient to form approximately a single revolution when the blank is coiled. Thus, the web is equal in length to band 12 in this embodiment. The web is formed from diagonally extending strips 18 in a zig-zag pattern, each strip 18 extending the full distance between the two bands and having a width of about 1/16 inch. Together with the two bands 12 and 14, the diagonal strips 18 define open triangles 20 in which the base 22 of each triangle coincides with the edge of one of the bands. The triangles 20 are in nested configuration, with every other triangle inverted. Depending upon the dimensions of the web in the blank, either five or six triangles are preferred. These triangles may be equilateral or isosceles. At each longitudinal end of the web, the two bands are connected by a normal, transverse strip 24. The end strips interrupt the repeating pattern of triangles and laterally truncate the usual triangular opening to form a resulting smaller right triangle 26 of only a portion of the area of a full triangle 20 and have a shorter base 28.

Figure 2:
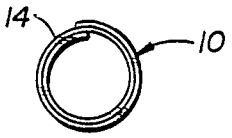
FIG. 2 is an end view of the impedance inducing device of FIG. 1 in coiled position, showing the configuration of the longer band.
Figure 3:
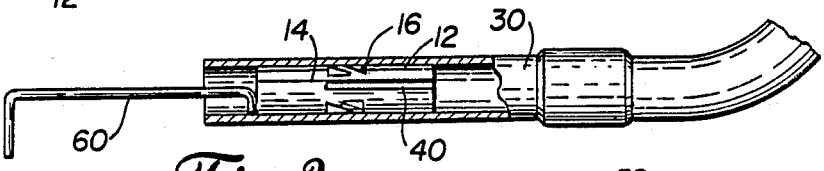
FIG. 3 is a side view of the coiled impedance inducing of FIG. 2 being installed in the tubing of a musical instrument, with the side of the tubing cut away for clarity.

The blank 10 may be sized to fit a variety of instruments or tubing sizes. The length of the bands is preselected to form substantially complete revolutions when coiled, as shown in FIG. 2, to fit within the tubing of an instrument. When the coiled blank 10 is inserted in the instrument's tubing as shown in FIG. 3, the coil's thickness is substantially uniform around the full circumference of each band. Thus, in FIG. 2 the longer, second band 14 is seen to form two substantially complete windings of the coil. The first band 12 will form a ring of substantially a single revolution and, thus, will have only approximately one-half the final wall thickness as the coil of the second band 14. It is acceptable for the first band 12 and web 16 to leave a small open slot 40 between their coiled ends.

Figure 5:
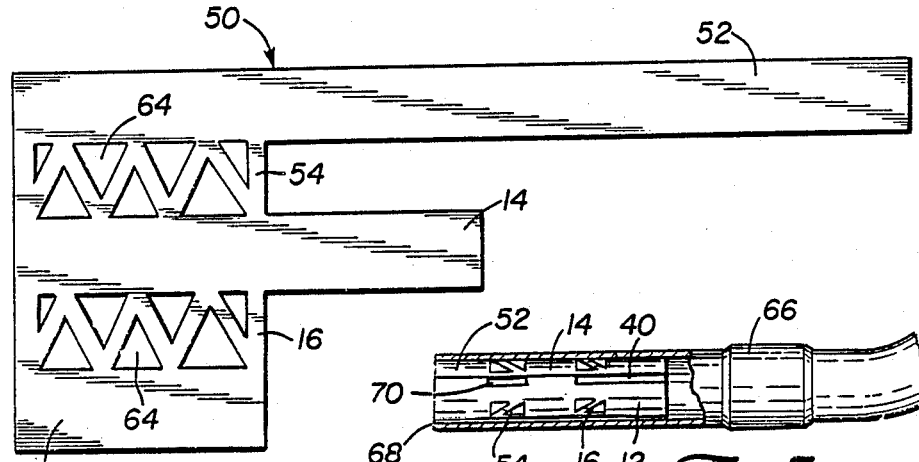
FIG. 5 is a plan view of a blank of a second embodiment of the impedance inducing device.

FIG. 5 shows another embodiment 50 of a blank for the device, in which the blank 50 has an additional web and band. As described in connection with blank 10, blank 50 has a first band 12 of a length suitable to form approximately a single coil circle when would to fit within the tubing of an instrument. A second band 14 is twice the length as band 12 and will form a two coil circle when wound to fit the instrument's tubing. A first web 16 of the same length and width as band 12 interconnects bands 12 and 14. The third, additional band 52 is twice the length of band 14 and, correspondingly, four times the length of band 12.

Figure 6:
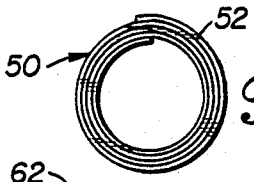
FIG. 6 is an end view of the impedance inducing device of FIG. 5, showing the configuration of the longest band.

FIG. 6 shows the circular constriction formed by band 52 when it is coiled to fit within the instrument's tubing. This constriction is defined by a four coil circle. This coiled circle of band 52 is connected to the circle of band 14 by a second web 54 having the same length as web 16. All bands and webs within a single blank may have the same width. The second web 54 is substantially identical to first web 16 and defines similar nested open triangles 64 with their base edges at the sides of the bands. When blank 50 is coiled, a first open slot 40 may be formed by the end edges band 12 and web 16. Another open slot 70 may be formed by the end edges of web 54, extending between bands 14 and 52.

The webs 16 and 54 each are of a length suited to form only approximately a single circle when the blank is coiled. It has been discovered that the end edges of the bands play an important function in the acoustical reinforcement of the invention. The coiled bands thus provide a constriction, created by the body of the band, and provide reflective edges. Each web provides a constriction between the bands, and each web blocks a portion of the neighboring bands' edges. For this reason, both the thickness of the web and the junctions with the neighboring bands have the ability to degrade the performance of the inserted coils. However, a means of accurately spacing the bands and maintaining the bands at the desired separation is highly desirable. The nested, triangular openings in the web reduce the effective constriction created by the web. The placement of the triangles' bases at the edges of the neighboring bands restores the availability of those edges for reflection of sound waves.

The blank 10 of FIG. 1 has been adapted to the following instruments with the measurements given in the following examples:

EXAMPLE 1

Trumpet, French Horn and Alto Saxophone

Material—0.005 inch industrial polyester.
Band 1 width—$\frac{3}{8}$ inch.
Band 1 length—$1\frac{3}{8}$ inches.
Band 2 length—$2\frac{5}{8}$ inches.
Band 2 width—$\frac{3}{8}$ inch.
Web length—1 $\frac{3}{8}$ inches.
Web width—$\frac{3}{8}$ inch.
Triangle 20 base—6 @5/16 inch.
Triangle 26 base—2 @$\frac{1}{8}$ inch.
The open triangles 20 are equilateral.

Installation is done by compressing the coil with the free end of the second band 14 inside the coil. The resulting structure has a two revolution coil formed by the second band and, hence, the coil may be viewed as a closed ring at the second band. The first band 12 and web 16 are formed by only a single revolution and, hence, the coil may be viewed as open at the first band and web, where the open end of slot 40 may or may not be evident. The end of the coil defined by the first band 12 will be referred to as the open end.

As shown in FIG. 3, the coil is inserted with the open end first into the tuning slide 30 of the instrument. A distance gauge 60 is used to push the coil into the tuning slide by a predetermined set back, which is the same distance as the width of the web. The gauge 60 also may be used to assure that the coil edges are evenly aligned. When inserted in this manner, the first band of the coil creates a ring having a wall thickness of approximately 0.005 inch and the second band creates a ring having a wall thickness of approximately 0.010 inch.

Figure 4:
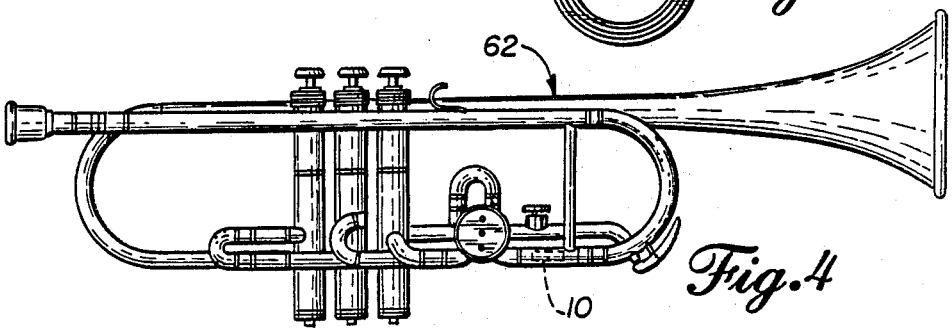
FIG. 4 is a side elevational view of a trumpet, showing placement of the coil in the air column.

The tuning slide 30 a trumpet or french horn supplements the series of impedances created by the first and second bands. As noted above, the second band is spaced inwardly of the end of the tuning slide by the same distance as the width of the web 16. Typically, the tuning slide of a trumpet or french horn has a wall thickness of about 0.020 inch. Thus, the combination of the end of the tuning slide, the second band, and the first bank creates a series of discontinuities and constrictions in the ratio of 4:2:1, which is known to provide constructive interference that supports a standing wave and results in improved response. FIG. 4 shows the resulting position of the device 10 in the air column of a trumpet 62.

EXAMPLE 2

Piccolo Trumpet and Flugelhorn

Material—0.005 inch industrial polyester.
Band 1 length—1 3/16 inches.
Band 1 width—$\frac{3}{8}$ inch.
Band 2 length—$2\frac{3}{8}$ inches.
Band 2 width—$\frac{3}{8}$ inch.
Web length—1 3/16 inches.
Web width—$\frac{3}{8}$ inch.
Triangle 20 base—5 @5/16 inch.
Triangle 26 base—2 @$\frac{1}{8}$ inch.

Installation is similar to that described in Example 1. In the case of these instruments, the coil is inserted into the tuning pipe with the open end of the coil closest to the mouthpiece. The recess from the forward end of the tuning pipe is the same as the web width, $\frac{3}{8}$ inch, so that the end of the tuning pipe furthest from the mouthpiece provides the third discontinuity in the series.

EXAMPLE 3

Trombone/Euphonium and Tenor/Baritone Saxophone

Material—0.007 inch industrial polyester.
Band 1 length—1 9/16 inches.
Band 1 width—$\frac{1}{2}$ inch.
Band 2 length—2 15/16 inches.
Band 2 width—$\frac{1}{2}$ inch.
Web length—1 9/16 inches.
Web width—$\frac{1}{2}$ inch.
Triangle 20 base—5 @$\frac{3}{8}$ inch.
Triangle 20 side—7/16 inch.

The web of this blank forms isosceles triangles instead of equilateral. Thus, the length of a side wall is given, as well.

Installation is similar to that described in Example 1. The coil is inserted into the tuning slide of a trombone/euphonium, with the open end first. The recess from the lower end of the tuning slide is the same as the web width, $\frac{1}{2}$ inch, so that the end of the tuning slide provides the third discontinuity in the series.

The coil is inserted into the mouthpiece receiver of the tenor/baritone saxophone, open end first. The recess from the mouthpiece end is $\frac{1}{2}$ inch so that the tip of the mouthpiece receiver provides the third discontinuity in the series.

Blank 50 of FIG. 5 has been adapted to the following instruments, with the dimensions given below:

EXAMPLE 4

Tuba and Bassoon

Material—0.010 inch industrial polyester.
Band 1 length—1 9/16 inches.
Band 1 width—$\frac{1}{2}$ inch.
Band 2 length—3 inches.
Band 2 width—$\frac{1}{2}$ inch.
Band 3 length—5 $\frac{7}{8}$ inches.
Band 3 width—$\frac{1}{2}$ inch.
First Web length—1 9/16 inches.
First Web width—$\frac{1}{2}$ inch.
Second Web length—1 9/16 inches.
Second Web width—$\frac{1}{2}$ inch.
Triangle 20 base—5 @$\frac{3}{8}$ inch.
Triangle 20 side—7/16 inch.

The web of this blank forms isosceles triangles 64 instead of equilateral. Thus, the length of a side wall is given, as well.

Figure 7:
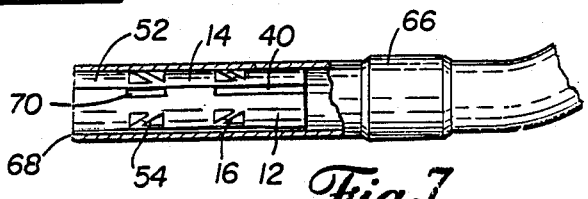
FIG. 7 is a side view of the coiled impedance inducing device of FIG. 6, installed in the tubing of a musical instrument, with the side of the tubing cut away for clarity.

Installation in the tuba is in the tuning slide 66, FIG. 7. The coil is inserted with the open end first until flush with the edge 68 of the tuning slide. No set back or recess is desired, as the third band 52 now provides the additional constriction in the 4:2:1 series. The tuning slide of the tuba may be received in a locally enlarged section of the instrument's tubing, making the end edge 68 of the slide unavailable for use as part of the reflective system.

Installation in the bassoon is in the bottom of the tenor section. The coil is inserted open end first until flush with the lower edge of the tenor section. Due to the large diameter of the tenor section, the slot 40 between the ends of the first band and first web is evident. This slot is aligned with the open C# hole of the instrument.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. An acoustical impedance inducing device for axial insertion into a longitudinal air column of a wind musical instrument, comprising:

a first annular band of first predetermined thickness;

a second annular band of second predetermined thickness, wherein said second predetermined thickness is approximately twice said first predetermined thickness; and a first web interconnecting said first and second bands and maintaining said bands at a predetermined axial spacing, wherein said web is formed of strips diagonally disposed between the first and second bands and defining a triangle shaped aperture between adjacent bands, with a base of the triangle being colinear with an edge of one of said first and second bands.

2. The acoustical impedance inducing device of claim 1, wherein a axial dimension of said web is substantially the same as an axial dimension of said first band.

3. The acoustical impedance inducing device of claim 1, wherein an axial dimension of said first and second bands is substantially equal.

4. The acoustical impedance inducing device of claim 1, wherein the thickness of said second band is at least approximately 0.010 inches.

5. The acoustical impedance inducing device of claim 1, wherein the thickness of said second band is at least approximately 0.014 inches.

6. The acoustical impedance inducing device of claim 1, wherein the thickness of said second band is at least approximately 0.040 inches.

7. The acoustical impedance inducing device of claim 1, wherein said second band comprises a coil of multiple layers of sheet material.

8. The acoustical impedance inducing device of claim 1, wherein said second band comprises a coil of approximately at least two layers of sheet material.

9. The acoustical impedance inducing device of claim 1, wherein said first web comprises a ring of sheet material.

10. The acoustical impedance inducing device of claim 9, wherein said ring of the first web is substantially a single layer of sheet material.

11. The acoustical impedance inducing device of claim 1, further comprising:

a third annular band of third predetermined thickness, wherein said third predetermined thickness is approximately twice the thickness of said second annular band; and a second web interconnecting said second and third bands at an axial edge of the second band opposite from said first web.

12. The acoustical impedance inducing device of claim 11, wherein said third band has a thickness of at least approximately 0.040 inches.

13. The acoustical impedance inducing device of claim 11, wherein an axial dimension of said second web is substantially equal to an axial dimension of said third band.

14. The acoustical impedance inducing device of claim 11, wherein an axial dimension of said third band is substantially equal to an axial dimension of the second band.

15. A method of producing an acoustical impedance inducing device adapted for axial insertion into an air column of a wind musical instrument, comprising the steps of:

selecting sheet material of predetermined thickness;

forming said sheet material into a blank having at least three connected, sequentially laterally juxtaposed strips of predetermined length and width, wherein the length of the third strip is approximately twice the length of the first strip, and the second strip defines a web having a plurality of generally triangular apertures with a base of the triangles at an side edges of the first and third strips;

longitudinally coiling said blank into a cylinder of substantially uniform diameter, such that each strip forms a coiled ring, wherein the ring of the third strip has a side wall thickness that is a multiple of the original thickness of the sheet material, and the ring of the first strip has a side wall thickness that is approximately one-half the side wall thickness of the ring of the third strip.

16. The method of claim 15, wherein said forming step further comprises:

forming said sheet into at least five connected, sequentially laterally juxtaposed strips, wherein a length of the fifth strip is twice the length of said third strip, and a fourth strip defines a plurality of generally triangular apertures having a base of the triangles at side edges of the third and fifth strips; and wherein in said coiling step, the ring formed by said fifth strip has a side wall thickness that is approximately twice the side wall thickness of the ring of the third strip.

17. A method of constructing a sequential series of discontinuities and constrictions having a ratio of 4:2:1 in a selected tubular portion of a wind musical instrument, wherein the selected tubular portion has an exposed end edge of predetermined wall thickness and inside diameter, comprising the steps of:

forming a coil of sheet material of suitable diameter to be firmly located in said selected tubular portion of the wind musical instrument, wherein said coil has two axially aligned, cylindrical rings separated by a web of predetermined axial width, the first ring having a predetermined wall thickness, the second ring having a wall thickness twice that of the first ring, and the web being defined by connecting strips that define apertures of generally triangular shape with a base of the triangle lying on an edge of one of said rings;

inserting said coil into the selected tubular portion of the wind musical instrument; and recessing said coil from said exposed end edge of the tube by an axial distance approximately equal to the axial width of said web;

wherein said predetermined wall thickness of the selected tubular portion at the exposed end edge of the tube is approximately twice the wall thickness of said second ring.

18. The method of claim 17, wherein said selected tubular portion of the wind musical instrument comprises a tuning slide.

19. The method of claim 17, wherein said selected tubular portion of the wind musical instrument comprises a tuning pipe.

20. The method of claim 17, wherein said selected tubular portion of the wind musical instrument comprises a mouthpiece receiver.

21. The method of claim 17, wherein said selected tubular portion of the wind musical instrument comprises a tenor section.

* * * * *